US006676532B1

(12) United States Patent
Boulton et al.

(10) Patent No.: US 6,676,532 B1
(45) Date of Patent: Jan. 13, 2004

(54) SCREEN ASSEMBLY

(75) Inventors: Robert Boulton, 20 Greenmeadow Grove, Endon, Stoke-on-Trent, Staffordshire, ST9 9EU (GB); Richard Anthony Mason, 37A Hurst Lane, Bollington, Macclesfield, Cheshire, SK10 5LT (GB)

(73) Assignees: Robert Boulton, Staffordshire (GB); Richard Anthony Mason, Cheshire (GB)

( * ) Notice: Subject to any disclaimer, the term of this patent is extended or adjusted under 35 U.S.C. 154(b) by 0 days.

(21) Appl. No.: 09/511,027

(22) Filed: Feb. 23, 2000

(30) Foreign Application Priority Data

Mar. 2, 1999 (GB) ..... 9904650

(51) Int. Cl.[7] ..... A63B 57/00; A63B 69/36; A63B 67/05; A63B 69/00; A63B 71/00

(52) U.S. Cl. ..... 473/197; 473/421

(58) Field of Search ..... D21/480, 780, D21/791, 48; 273/398, 404, 410; 473/150, 197, 421, 422, 446, 407; 476/460, 478, 493, 494, 495, 510

(56) References Cited

U.S. PATENT DOCUMENTS

| | | | | | |
|---|---|---|---|---|---|
| 349,686 | A | * | 9/1886 | Braithwaite et al. | 473/493 |
| 906,848 | A | * | 12/1908 | Atwell | 473/493 |
| 1,300,972 | A | * | 4/1919 | Janssen | 473/493 |
| 1,526,126 | A | * | 2/1925 | Fitzherbert | 473/493 |
| 1,591,753 | A | * | 7/1926 | Flaugh | 473/421 |
| 2,915,314 | A | | 12/1959 | Phillips | |
| 4,063,739 | A | | 12/1977 | La Rose | |
| 4,072,295 | A | | 2/1978 | Roberts | |
| 4,127,267 | A | | 11/1978 | Bay et al. | |
| 4,169,658 | A | * | 10/1979 | Brown | 352/36 |
| 4,595,155 | A | * | 6/1986 | Gough | 242/395.1 |
| 4,838,558 | A | * | 6/1989 | Hauff | 273/395 |
| 4,880,239 | A | | 11/1989 | Leneveu | |
| 5,139,256 | A | * | 8/1992 | Logan | 256/11 |
| 5,286,029 | A | | 2/1994 | Smit | |
| 5,562,288 | A | * | 10/1996 | Erkebaev | 273/396 |
| 5,690,339 | A | | 11/1997 | Chen | |
| 5,722,905 | A | | 3/1998 | Bidelman | |
| 5,810,363 | A | * | 9/1998 | Saunders et al. | 273/407 |

FOREIGN PATENT DOCUMENTS

DK 003816594 A1 * 11/1989 ..... A63B/61/00

* cited by examiner

*Primary Examiner*—Paul T. Sewell
*Assistant Examiner*—Alvin A. Hunter, Jr.
(74) *Attorney, Agent, or Firm*—Watts Hoffmann co., L.P.A.

(57) ABSTRACT

A screen assembly (10, 110, 160) usable as golf practice apparatus, the assembly comprising a rotatable upstanding elongate member (12, 112) from which netting screens (16, 116) can extend in a generally vertical plane, and which can be wound around the member (12, 112) when not in use. A constant force spring (28, 128) is provided for automatic rewinding of the screens (16, 116) onto the member (12, 112). The free ends of the screens (16, 116) are provided with bars (22, 122) which are engageable with the ground in use. Further screens (20, 21, 120, 121) are provided to protect the joint between the screens (16, 116) and also to provide a ceiling layer therebetween.

11 Claims, 5 Drawing Sheets

SCREEN ASSEMBLY

This invention concerns a screen assembly, and particularly but not exclusively a screen assembly in the form of golf practice apparatus.

Golf practice nets, i.e. nets into which a golf ball can be hit, are in general relatively cumbersome. Such arrangements often require at least two people for erection and are relatively bulky when not in use. Furthermore, when used outdoors they can result in a particular area of ground becoming very worn.

According to the present invention there is provided a screen assembly, the assembly comprising a first elongate member rotatably mountable on the ground to be upstanding therefrom; a screen member movable by virtue of rotation of the first member, between a storage condition wrapped around the first member, and a use condition extending from the first member in an at least generally vertical plane; means for supporting the screen member in the use condition; and spring means, the spring means being arranged to automatically rotate the first member to wind the screen member therearound when moving from the use condition to the storage condition.

The supporting means may comprise a second elongate member, in which the second member is mounted on the screen member at or adjacent the free end thereof. The second member may be mounted in a loop formed at the free end of the screen member. The second member may comprise a lower selectively retractable part to be retracted in the storage condition, and ground engaging in the use condition. The retracted part may be telescopic, and may comprise a pointed part which can be pushed into the ground. Alternatively, the retractable part could comprise a ground engageable wheel, and 4 selective bracing means may be provided for the wheel. The retractable parts could be interchangeable for use on different surfaces.

Means are preferably provided for retaining the screen member in the use condition. The second member may be arranged to retain the screen member in the use condition by virtue of the engagement of the second member with the ground. A socket arrangement may be provided which is mountable in the ground and with which the second elongate member is engageable. Alternatively, a ground engaging base may be provided with which base the second elongate member is engageable.

A socket arrangement may be provided which is mountable in the ground and with which the first member is engageable. Alternatively, a ground engaging base may be provided with which base the first member is engageable.

Means may be provided for locking the first member against rotational movement. The locking means may be operatively engageable with the socket arrangement or base.

The locking means may be automatically engageable, and may be automatically engageable when the screen member is substantially fully unwound from the first member.

Alternatively, means may be provided for manually locking the first member.

The screen member may comprise a fabric netting material. Means may be provided to permit a lower part of the screen member to be folded up onto the remainder for storage, and said mens may comprise a plurality of strips of respective parts of fleece and hook fastener on said lower part and remainder of the screen member.

The spring means may comprise a constant force spring.

The assembly may comprise a pair of screen members arranged to extend away from the first member inclined relative to each other in the use condition. The assembly may comprise a third screen member which extends between the pair of screen members, desirably substantially from upper edges of the pair of screen members. The third screen member may be arranged to extend in a generally horizontal plane in the use condition.

Alternatively the third screen member may be arranged to incline upwardly away from the pair of screen members in the direction of their deviation.

Means may be provided for supporting the third screen member in the use condition. Said means may comprise one or more elongate support member extendable from the first elongate member. The support members may be telescopic, or means may be provided for moving the support members to a supporting position; which means may be automatically operable upon the screen members being moved to the use condition. Alternatively or in addition, rigid and/or spring members may be locatable extending across the third screen member in the use condition.

Means may be provided for tensioning the material of the screen members, and tapes may be provided extending thereacross, which tapes incorporate tensioning means.

The pair of screen members may connect together along respective ends thereof, which ends may be locatable on or adjacent the first elongate member in the use condition.

Alternatively, a fourth screen member may extend between the closer ends of the pair of screen members, which closer ends are preferably spaced apart and/or spaced from the first elongate member in the use condition. A protective screen member may be provided extending over the fourth screen member.

A cover may be provided locatable over the assembly in the storage condition. The cover may be made of a fabric material and may comprise a closure arrangement. Alternatively the cover may be rigid, and may be lockable in a closed condition.

The invention also provides a golf practice apparatus, the apparatus comprising a screen assembly into which a golf ball can be hit, the assembly being according to any of the preceding sixteen paragraphs.

Embodiments of the present invention will now be described by way of example only and with reference to the accompanying drawings, in which.

Figure 1:
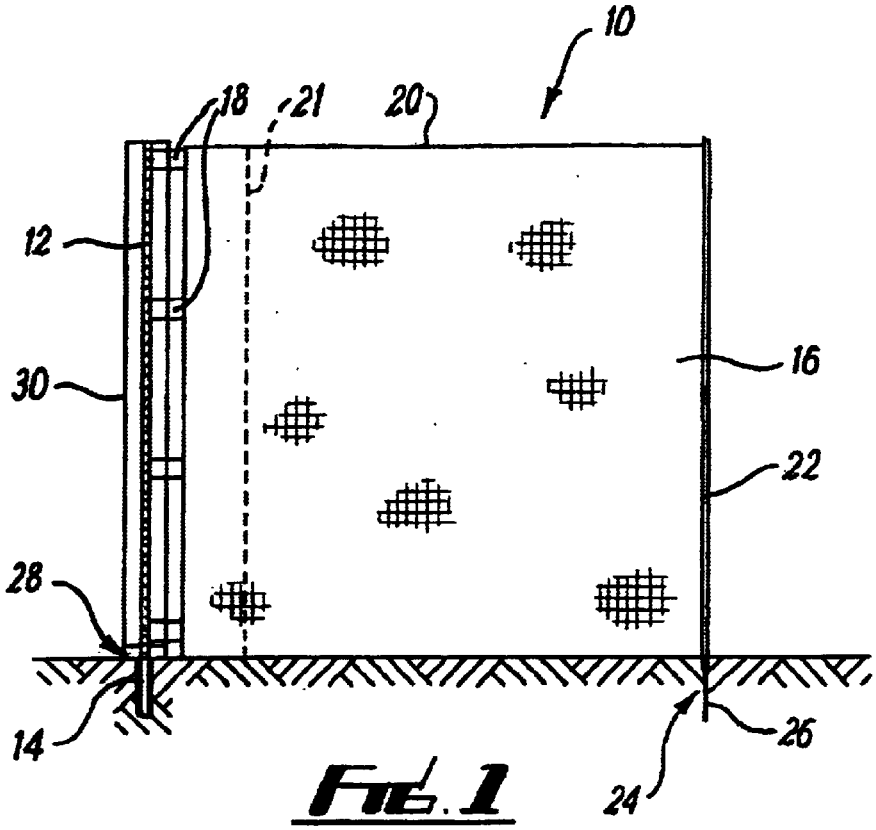
FIG. 1 is a diagrammatic side view of a first screen assembly according to the present invention.
Figure 2:
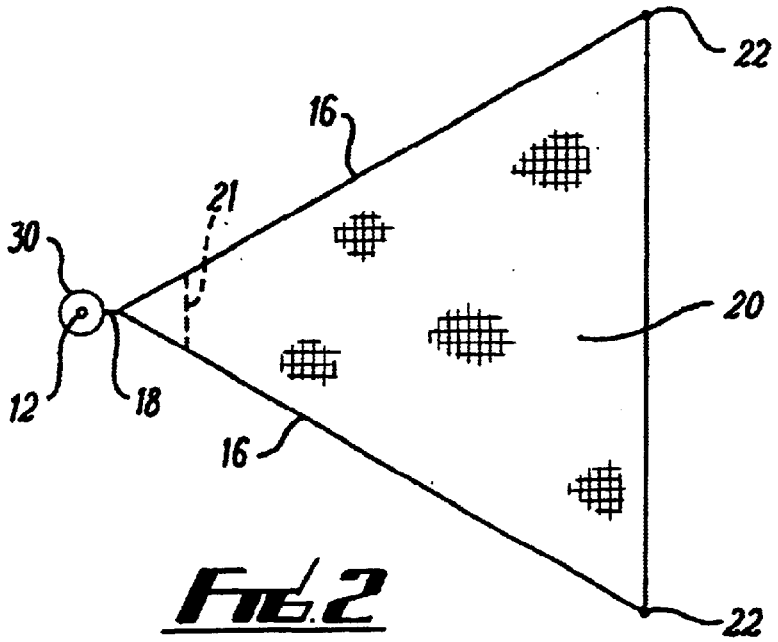
FIG. 2 is a plan view of the assembly of FIG. 1.

FIGS. 1 and 2 of the drawings show a golf practice assembly 10. The assembly 10 comprises a rotatable upstanding elongate member 12. The lower end of the member 12 is located in a socket arrangement 14 mounted in the ground.

A pair of netting screens 16 are mounted on the member 12 by four spaced mounting strips 18. The screens 16 are arranged to extend from the member 12 in a generally vertical plane. A further netting screen 20 extends between upper edges of the two screens 16. A still further smaller netting screen 21 extends in a generally vertical plane between the three screens 16,20 a short distance from the strips 18. The screen 21 provides a wall to protect the join between the screens 16, and also the member 12. The screen 20 is triangular such that when the screens 16,20 are pulled generally taut, the two screens 16 are inclined relative to each other, with the screen 20 providing a ceiling layer between.

A bar 22 is provided on the free end of each of the screens 16, mounted in a loop provided in the free end of the screen 16. The bar 22 has a retractable lower part 24. The lower part 24 comprises a ground engageable spike 26. A constant force spring assembly 28 is provided towards the lower end of the member 12, and is arranged to urge the member 12 so as to wind the screens 16,20,21 therearound. A cylindrical casing 30 is co-axially mounted around the member 12, to receive the screens 16,20,21 and bars 22 when the assembly 10 is in a stored condition. A vertical slot is provided through the casing 30 to permit the screens 16,20,21 and member 12 to be pulled out of the casing 30.

In use, the assembly 10 can be stored with the screens 16,20,21 and bars 22 located within the casing 30. A cover (not shown) may be provided therefor. When it is required to use the assembly 10 for golf practice, the member 12 is inserted into the socket arrangement 14 so as to be upstanding. The screens 16,20,21 and bars 22 can be pulled from the casing 30, against the force of the spring assembly 28, such that the bars 22 are spaced from each other and the casing 30, with the screens 16,20 substantially taut. The lower parts 24 of the bars 22 which were previously retracted can now be extended and the spikes 26 inserted into the ground. The assembly 10 is arranged such that the resistance afforded by the ground engagement of the spikes 26 should prevent the screens 16,20,21 being pulled back into the casing 30.

The assembly can now be used for practising a person's golf swing, with the ball being hit into the substantially triangular space defined by the screens 16,20,21. When the assembly 10 is no longer required to be used, the lower parts 24 can be retracted and the screens 16,20,21 and bars 22 will be urged by the assembly 28 back into the casing 30. The member 12 can then be removed from the arrangement 14 for storage, or left there and a cover fitted thereover. A cap may be provided to close off the arrangement 14 when empty.

Figure 3:
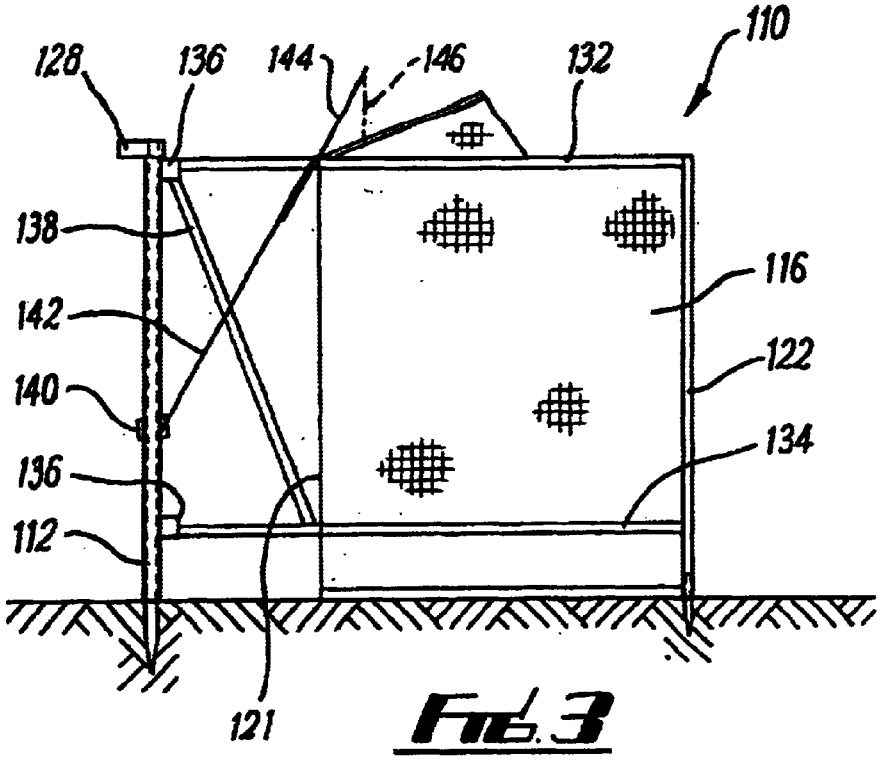
FIG. 3 is a similar view to FIG. 1 of a second screen assembly according to the present invention.
Figure 4:
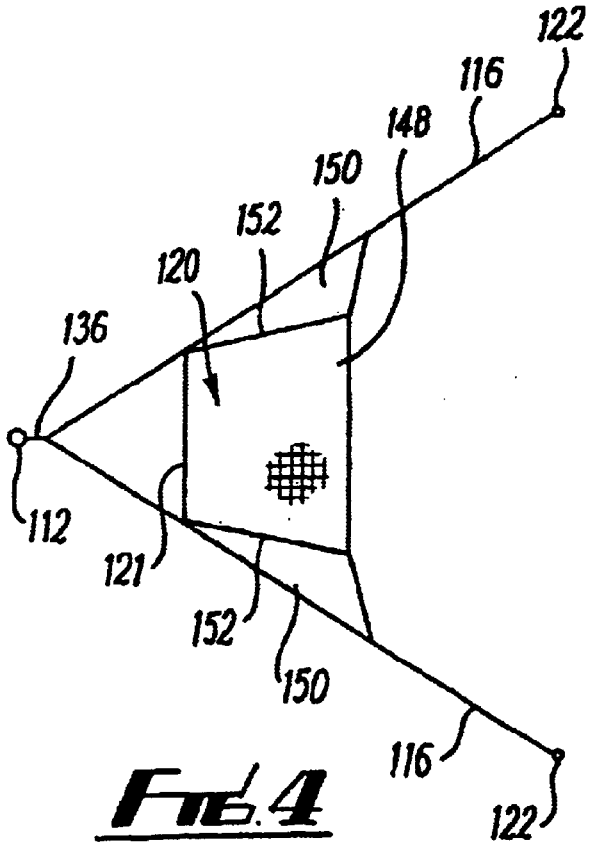
FIG. 4 is a similar view FIG. 2 of a second screen assembly according to the present invention.
Figure 5:
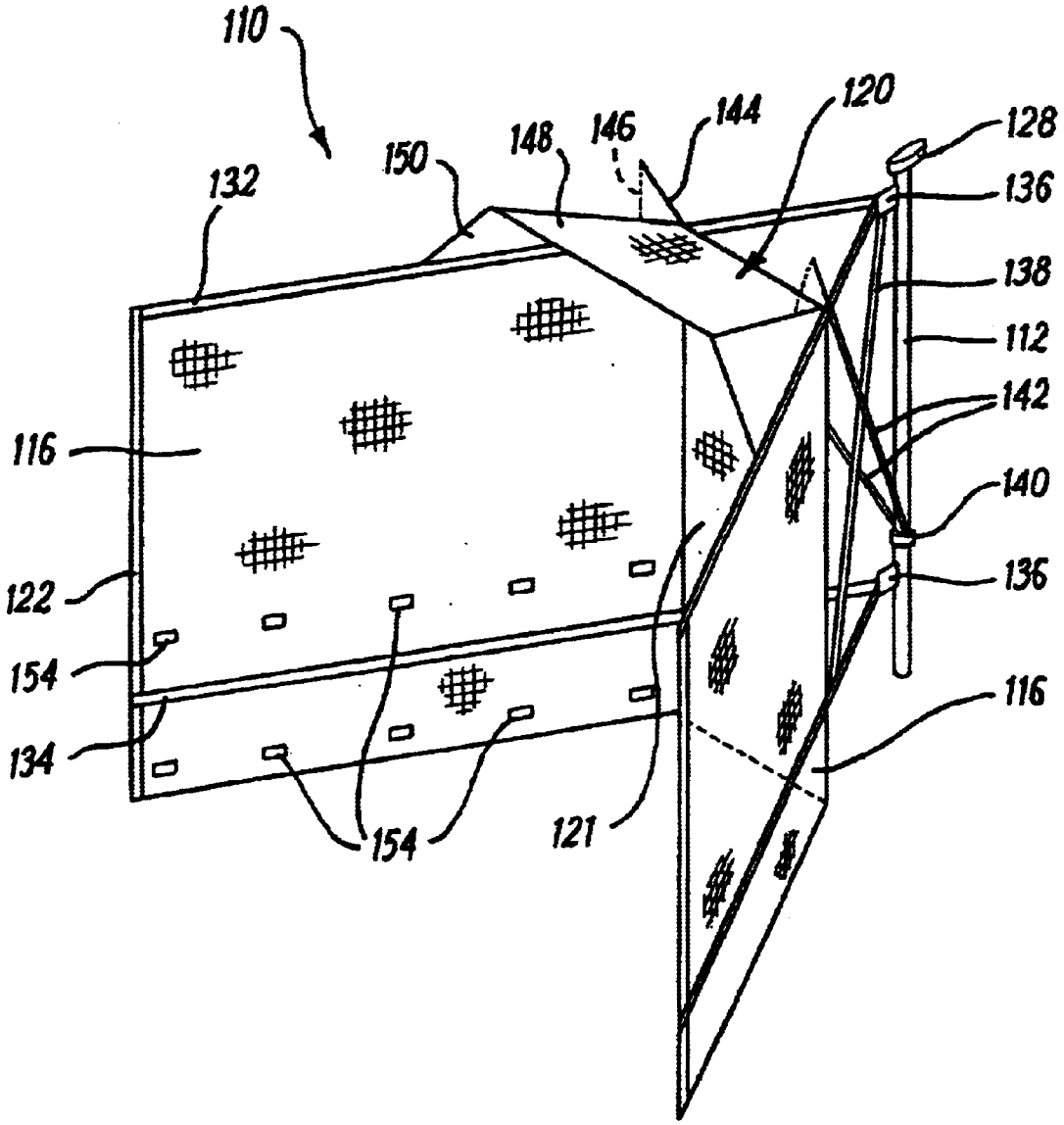
FIG. 5 is a perspective view of the second assembly.

FIGS. 3–5 show a further golf practice assembly 110. The assembly 110 is similar in many respects to the assembly 10 and similar reference numerals shall be used but with one hundred added thereto. A pair of netting screens 116 are again provided but in the use condition these are spaced further from the rotatable upstanding elongate member 112. The closer edges of the screens 116 are spaced further from each other than the similar edges of the screens 116, and said edges of the screens 116 are interconnected by a further netting screen 121.

The screens 116 are connected to the member 112 by a pair of tapes 132 which extend along their upper edges, and a further pair of tapes 134 which extend spaced above the lower edge of the screens 116, and extend across a space to the member 112. The respective pairs of tapes 132,134 are connected together in pairs respectively by tabs 136 adjacent the member 112. The tabs 136 extend through a longitudinal slot (not shown) in the member 112 and are retained therein by wider base portions.

A further pair of tapes 138 extend respectively from the upper tab 136 to the tape 134 immediately behind the screen 121. A freely rotatable collar 140 is provided around the member 112 a short distance above the lower tab 136. Ends of respective elongate members 142 are selectively mountable on the collar 140 with the members 142 pivotally mounted to the tapes 132 at the top respective corners of the screen 121. An upper telescopic portion 144 is provided on the members 142 with line means 146 extending therefrom.

A further netting screen 120 again extends between the upper edges of the two screens 116. The screen 120 comprises a larger central portion 148 and two triangular side portions 150. Sleeves 152 are provided along the edges between the portions 148 and 150, in which sleeves 152 removable support members (not shown) are locatable. The line means 146 respectively connect to the sleeves 152 a short distance from the screen 121.

Loops are again provided on the free ends of the screens 116 in which bars 122 are mounted. Beneath the tapes 134 the loops are openable to permit release from the bars 122. A plurality of pieces 154 of fleece and hook fastener are provided along the lower edge of the screens 116 and spaced a similar distance above the tapes 134 to permit the parts of the screens 116 beneath the tapes 134 to be folded up when not in use. A further protective screen (not shown) is provided extending over the screen 121 to protect same against the impact of balls. With the assembly 110 the constant force spring assembly 128 is located on the top end of the member 112.

In use, the assembly 110 can be stored in a similar manner to the assembly 10. For use, the screens 116,120,121 and bars 122 are pulled outwardly and the bars 122 fitted in position. A lock is preferably provided on the member 112 to selectively prevent rotation thereof. The lock may be engageable in the ground or a base plate (not shown) to selectively prevent rotation. Alternatively, the lock may be automatically operable when the screens 116 are pulled to their fullest extent.

With the screens 116 fully extended the elongate members 142 are located on the collar 140 and the telescopic parts 144 extended to raise the screen 120. If not already done so the support bars are entered in the sleeves 152. The lower parts of the screens 116 which will be folded up are lowered and the loops closed around the bars 122 below the tapes 134.

Figure 6:
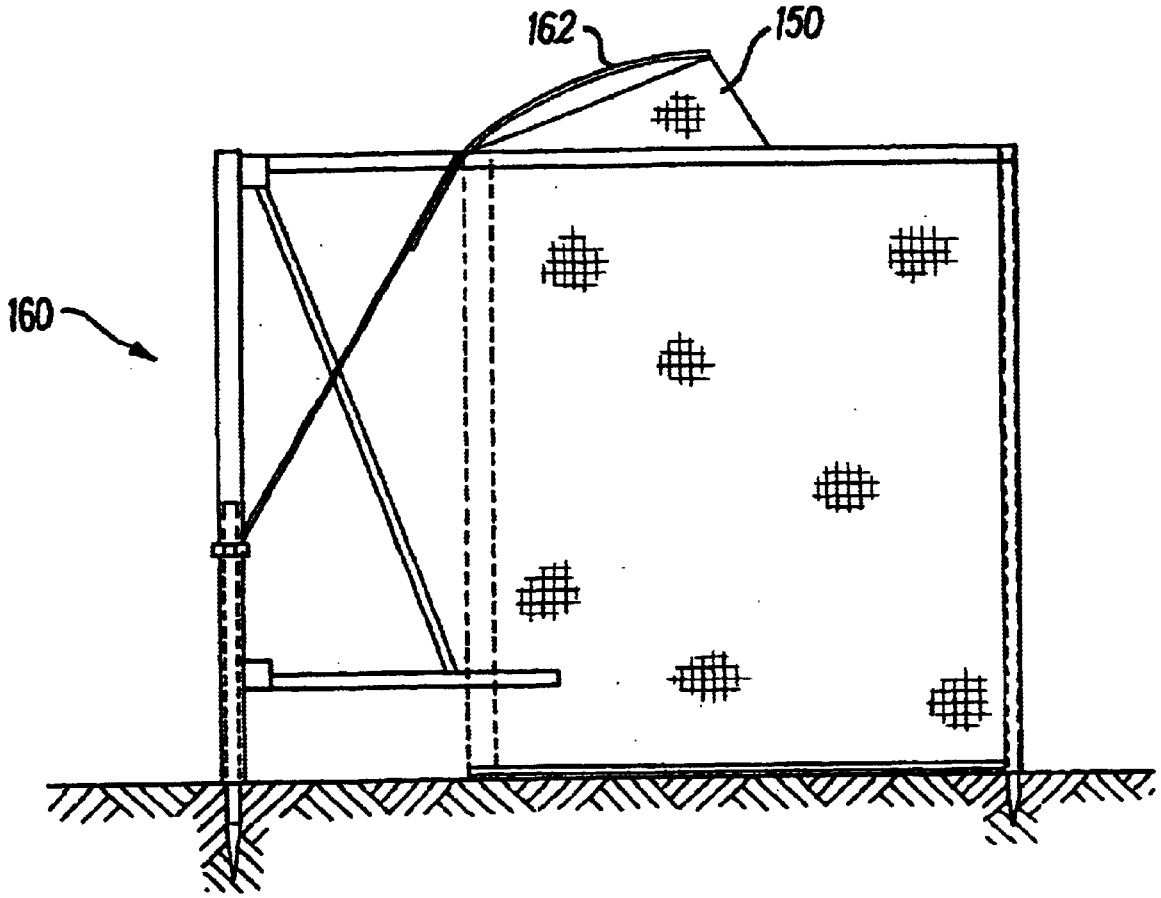
FIG. 6 is a similar view to FIG. 3 of a second screen assembly according to the present invention.
Figure 7:
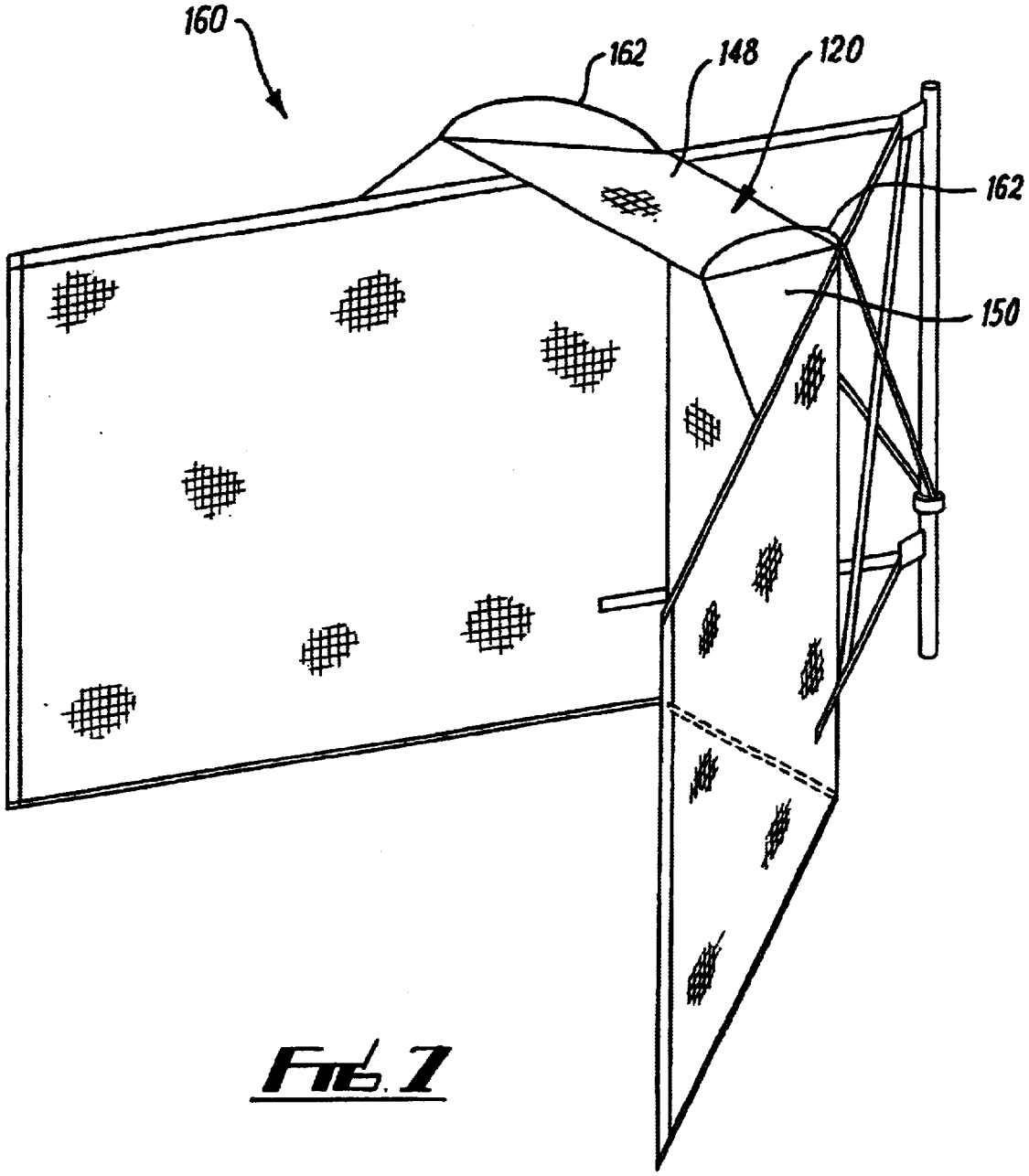
FIG. 7 is a similar view FIG. 5 of a second screen assembly according to the present invention.

FIGS. 6 and 7 show a still further golf practice assembly 160 which is similar in most respects to the assembly 110. In this instance the further netting screen 120 is supported by fibre glass struts 162 which telescopically extend in an arc from the respective elongate members 142 and connect to the far edge of the screen 120 at the connection between the positions 148,150.

There are thus described golf practice assemblies which provide a number of advantages. The assemblies are of relatively straightforward construction and can thus be inexpensively, robustly and lightly manufactured. The assemblies can readily be erected by a person on their own. The assemblies are arranged such that the screens can extend outwardly at any orientation therefrom, thereby permitting the assembly to be used at different positions around the arrangement to prevent wear of the ground at a particular point. The spring assembly being of the constant force type prevents whipping of the bars, and eases unwinding of the components from the upstanding member.

Various modifications may be made without departing from the scope of the invention. For example, the screens could be differently mounted on the elongate member. Also, a different spring means may be provided for the elongate member. Other means could be provided for locking the elongate member against rotational movement. Such means could be automatically engageable on the screens being pulled to at least substantially their whole extent from the casing, and perhaps automatically subsequently unlock upon a tug of the screens.

The bars could be differently mounted and could comprise different ground engagement means. In some instances a retractable lower part need not be provided. For instance, a loop or other mounting arrangement could be provided through which a peg or similar could engage and then be pushed or driven into the ground. Alternative lower parts may be provided, such as ground engageable wheels, perhaps with selective braking devices. The lower parts could be interchangeable for use on different surfaces. The ends of the bars could mount in a socket in the ground or on a base, and removable mounting parts could be provided.

The collar as provided in the second embodiment could be mounted on the upright elongate member by a helical thread, such that relative rotation therebetween will cause the collar to rise or fall. If the support means for the upper netting screen are permanently mounted on the collar, unwinding of the assembly could cause automatic rising of the support means to a required position.

The invention is usable with a wide variety of applications other than golf practice apparatus. For example, the invention could be used with other sports nets, such as badminton nets etc. Alternatively the invention could be used with welding screens, hospital screens or other partitions. In these other applications it may only be necessary to provide one or two screens. Also, where the arrangement is to be used indoors or on solid surfaces, different ground engagement means would be used, such as feet or wheels. In the described example these screens comprise nylon net. However, a wide variety of different materials could be used as will be appropriate for particular applications.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A golf practice apparatus comprising a screen assembly, the assembly comprising;

a) an elongate member rotatably mountable on the ground to be upstanding therefrom;

b) a pair of screen members and a third screen member connected to the elongate member and extending between the pair when in use;

c) the screen members being movable by virtue of rotation of the elongate member, between a storage condition wrapped around the elongate member, and a use condition extending from the elongate member with the pair in generally vertical planes with the third screen member spanning between them in a further vertical plane, each of the screen members of the pair extending upwardly from the ground to delineate a ground collection space when the elongate member is mounted on the ground and the apparatus is in use to collect balls that have impacted against at least one of the screen members;

d) the pair of screen members being inclined relative to each other and flaring outwardly from opposite sides of the third screen member when in the use condition;

e) structure for supporting the screen members in the use condition; and, f) spring means, arranged to automatically rotate the elongate member to wind the screen members therearound when moving from the use condition to the storage condition.

2. A screen assembly according to claim 1, wherein said supporting structure comprises a pair of elongate members.

3. A screen assembly according to claim 1, further including locking means for locking said first member against rotational movement.

4. A screen assembly according to claim 3 wherein said locking means are automatically engageable when said screen members are substantially fully unwound from the elongate member.

5. A screen assembly according to claim 1, wherein said screen member comprises a fabric material.

6. A screen assembly according to claim 1, further including fastening means to permit a lower part of said screen member to be folded up onto the remainder for storage.

7. A screen assembly according to claim 1, wherein said spring means comprises a constant force spring.

8. A screen assembly according to claim 1, further including tensioning means for tensioning said screen members.

9. A screen assembly according to claim 1, wherein a fourth screen member extends between said pair of screen members and forwardly from the third member in the use condition to provide a top for at least a portion of the collection space.

10. A screen assembly for use in practicing golf comprising;

a) a tubular casing;

b) an elongate member rotatably mounted in the casing;

c) a pair of flexible side screens, a back screen between the pair and a too screen connected to the pair, the screens being secured to the elongate member and wound therearound when in a storage position;

d) the screens having a use position wherein the side screens define the sides of a practice ball receiving and collection space with the side screens flaring outwardly from the back screen and one another in a direction away from the elongate member, the top screen when in the use position defining a top of the receiving spacing;

e) support structures connected respectively to the side screens to maintain the side screens erect when in use and the top screen stretched between them, such that the screens collectively function to collect practice balls in the space collectively delineated by the screens.

f) a spring assembly operably connected to the casing and to the elongate member for rotating the member to wind the screens around the member as the screens are retracted from an extended use position to the storage position.

11. The assembly of claim 10 wherein each screen is comprised of netting.

* * * * *